US010427061B2

(12) United States Patent
Medwed

(10) Patent No.: US 10,427,061 B2
(45) Date of Patent: Oct. 1, 2019

(54) PLUSH STUFFED WITH MOLDED OR SCULPTED FOAM

(71) Applicant: GENNCOMM, LLC, Tarzana, CA (US)

(72) Inventor: Jeremy Brian Medwed, Woodland Hills, CA (US)

(73) Assignee: GENNCOMM, LLC, Tarzana, CA (US)

( * ) Notice: Subject to any disclaimer, the term of this patent is extended or adjusted under 35 U.S.C. 154(b) by 0 days.

(21) Appl. No.: 15/985,595

(22) Filed: May 21, 2018

(65) Prior Publication Data

US 2018/0333648 A1 Nov. 22, 2018

Related U.S. Application Data

(60) Provisional application No. 62/508,800, filed on May 19, 2017.

(51) Int. Cl.

| | |
|---|---|
| ***A63H 3/02*** | (2006.01) |
| ***A63H 3/06*** | (2006.01) |
| ***A63H 13/16*** | (2006.01) |

(52) U.S. Cl.

CPC ..... *A63H 3/02* (2013.01); *A63H 13/16* (2013.01)

(58) Field of Classification Search

CPC ..... A63H 3/02; A63H 13/16
USPC ..... 446/226, 369, 385, 73, 75, 268
See application file for complete search history.

(56) References Cited

U.S. PATENT DOCUMENTS

| | | | | | |
|---|---|---|---|---|---|
| 2,224,456 | A * | 12/1940 | Janas | A63H 3/04 | 446/300 |
| 3,354,578 | A * | 11/1967 | Ryan | A63H 3/02 | 446/369 |
| 4,170,086 | A * | 10/1979 | Hills | A63H 3/02 | 428/100 |
| 4,233,775 | A * | 11/1980 | Neufeld | A63H 3/04 | 446/370 |
| 4,505,687 | A * | 3/1985 | Munro | A63H 3/04 | 446/26 |
| 4,884,991 | A * | 12/1989 | Terzian | A63H 3/02 | 446/369 |
| 4,936,460 | A * | 6/1990 | Meyer | B65D 5/528 | 206/524.8 |
| 5,178,807 | A * | 1/1993 | Thary | A63H 3/02 | 264/338 |
| 5,224,894 | A * | 7/1993 | Nelson | A63H 33/004 | 428/17 |

(Continued)

*Primary Examiner* — Alexander R Niconovich
(74) *Attorney, Agent, or Firm* — SoCal IP Law Group LLP; Steven C. Sereboff

(57) ABSTRACT

A plush toy system comprises a foam inner, formed into a character shape, made with a compressible foam. A flexible outer covering surrounds the foam inner and has an inner surface for contacting the foam inner. The foam inner and the flexible outer covering combine to form a plush toy. The system may include a package having at least one open side through which the plush toy traversed when compressed to fill an interior space of the package. In use, when the plush toy is compressed and contained within the package, upon opening of the at least one open side the plush toy at least partially expands out of the at least one open side of the package. When removed completely from the package the plush toy expands to the natural size of the plush toy, preferably three times its size or more when compressed.

20 Claims, 5 Drawing Sheets

(56) References Cited

U.S. PATENT DOCUMENTS 5,462,473 A * 10/1995 Sheller ..... A63H 3/06 446/183
5,496,026 A * 3/1996 Montgomery ..... A63B 43/002 473/570
5,503,584 A * 4/1996 Tulling ..... A63H 33/20 446/369
5,613,892 A * 3/1997 Barton ..... A63H 3/06 446/224
5,649,875 A * 7/1997 Spector ..... A63B 65/00 446/226
5,813,896 A * 9/1998 Spector ..... A63G 19/18 446/221
5,885,128 A * 3/1999 Blaustein ..... A63H 3/02 446/369
5,895,308 A * 4/1999 Spector ..... A63H 5/00 446/183
5,897,418 A 4/1999 Spector
5,961,363 A * 10/1999 Spector ..... A63H 3/02 446/368
6,030,271 A * 2/2000 Pietrafesa ..... A63H 3/06 446/226
6,126,510 A * 10/2000 Weiss, Jr. ..... A63B 43/002 446/226
6,155,904 A * 12/2000 Spector ..... A63B 69/345 446/311
6,168,494 B1 1/2001 Engel
6,261,146 B1 * 7/2001 Spector ..... A63H 3/02 446/385
6,264,526 B1 * 7/2001 Meeker ..... A63H 3/02 446/369
6,575,807 B2 * 6/2003 Spector ..... A63H 3/02 446/320
6,881,119 B2 * 4/2005 Panec ..... A63H 3/02 446/183
7,682,216 B2 * 3/2010 Spector ..... A63H 33/38 281/31
7,887,387 B2 * 2/2011 Colvin ..... A63H 3/02 446/369
9,573,070 B2 * 2/2017 Morley ..... A63H 3/02
9,914,064 B2 3/2018 Daye
2003/0056292 A1 3/2003 Fenichel
2006/0054020 A1 3/2006 Dhillon
2009/0156089 A1 6/2009 Hoard
2010/0112892 A1 * 5/2010 LaPointe ..... A47G 9/0253 446/72
2012/0329363 A1 12/2012 Barthold
2014/0097122 A1 * 4/2014 Patterson ..... B65D 5/5226 206/758
2015/0289687 A1 10/2015 Day
2015/0290546 A1 * 10/2015 Alves ..... A63H 3/02 446/369
2016/0309682 A1 * 10/2016 Stone ..... A01K 15/025
2017/0065109 A1 3/2017 Peel
2017/0290450 A1 10/2017 Jaramillo
2018/0078060 A1 3/2018 Perez

* cited by examiner

PLUSH STUFFED WITH MOLDED OR SCULPTED FOAM

CROSS-REFERENCE TO RELATED APPLICATIONS

This application claims the benefit of U.S. Provisional Patent Application 62/508,800, filed on May 19, 2017, and incorporated herein by reference.

STATEMENT REGARDING FEDERALLY SPONSORED RESEARCH AND DEVELOPMENT

Not Applicable.

FIELD OF THE INVENTION

This invention relates to plush toys, and more particularly to a compressible viscoelastic or memory-foam based plush toy.

DISCUSSION OF RELATED ART

Plush toys are well known and have been a favorite style of toy for generations. Traditional plush toys are not easily compressed, however, for the purpose of reducing their shipping and storage size, and/or to conceal their expanded shape, without damaging the plush toy and permanently deforming it. Traditional polyester fiberfill and wool are used in the prior art, but such fill for a plush toy does not enable the plush toy to be compressed without damage and expand into its original shape.

Therefore, there is a need for a system that allows a plush toy to be compressed to ⅓ of its normal, expanded size, or more, without permanently deforming the plush toy or changing its shape when expanded to its natural size. Such a needed invention could include a package that is either a different shape than the final shape of the plush toy, promoting surprise and mystery for the end user of such a system, or that resembles the shape of the plush toy but in a miniature form, or that includes a plurality of such plush toys placed into a PDQ box or tray, or in other ways. Such a needed invention would be relatively inexpensive to manufacture, transport, and store. The present invention accomplishes these objectives.

SUMMARY OF THE INVENTION

The present device is a plush toy system comprising a foam inner formed into a character shape, such as a doll or animal. The foam inner comprises a compressible foam material and has an outer surface. The foam inner, when unconstrained, expands into a natural size.

A flexible outer covering surrounds the foam inner and is, in preferred embodiments, sized in at least one dimension to be smaller than the natural size of the foam inner. In other embodiments the outer covering may be sized substantially the same as the natural size of the foam inner, or larger than the natural size of the foam inner when a loose, baggy look is desired for the plush toy. The outer cover has an inner surface for contacting the foam inner, and an outer surface. The foam inner and the flexible outer covering combine to form a plush toy.

The system may include a package having at least one open side through which the plush toy traversed when compressed to fill an interior space of the package. The package may be a rectanguloid, a two-piece ovaloid, or the like. Preferably the foam inner is stored in its compressed size at 33% or less that of its natural, expanded size when unconstrained by the package.

In use, when the plush toy is compressed and contained within the package, upon opening of the at least one open side the plush toy at least partially expands out of the at least one open side of the package. When removed completely from the package the plush toy expands to the natural size of the plush toy.

The present invention is a plush toy that can be compressed to one-third of its normal, expanded size, or more, without permanently deforming the plush toy or otherwise changing its shape when expanded to its natural size. The present system may include a package that is either a different shape than the final shape of the plush toy, promoting surprise and mystery for the end user of such a system, or that resembles the shape of the plush toy but in a miniature form, or that includes a plurality of such plush toys placed into a point-of-purchase display box or tray, or in other ways. The present invention is relatively inexpensive to manufacture, transport, and store. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
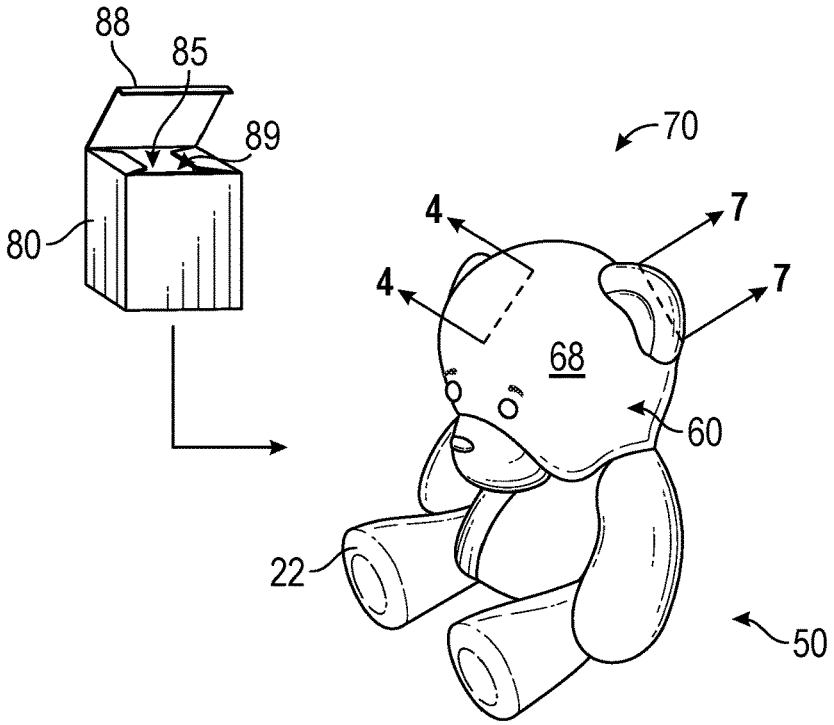
FIG. 1 is an exploded perspective view of the invention, illustrating a plush toy expanded to a natural size after being removed from a package of the invention.
Figure 2:
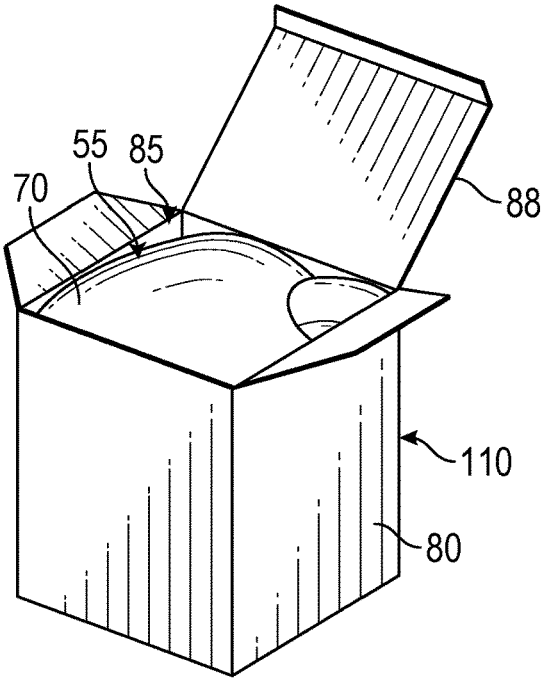
FIG. 2 is a perspective view of the invention, illustrating the plush toy as contained in the package just as the package is opened.
Figure 3:
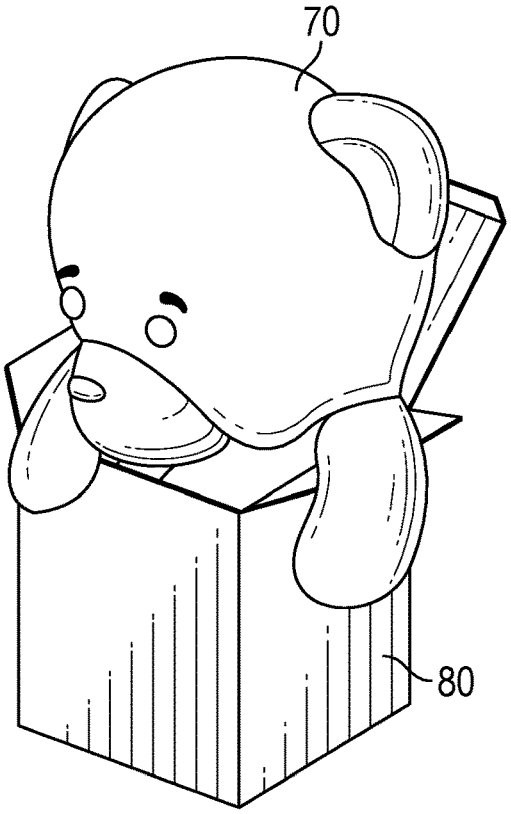
FIG. 3 is a perspective view of the invention, illustrating the plush toy expanding out of the package after the package is opened.

FIGS. 1-3 illustrate a plush toy system 10 comprising a foam inner 20 formed into a character shape 30, such as a doll, animal, or other character shape. The foam inner 20 comprises a compressible, preferably either an open or closed-cell viscoelastic foam material 40 and has an outer surface 28. The foam inner 20, when unconstrained, expands into a natural size 50. The foam inner 20 may comprise a polyurethane or latex viscoelastic foam material, or other foam material that expands from a compressed state, preferably to three times or more of its compressed size 55. Such a foam inner 20 may be made with an injection molding process, or by cutting and shaping a foam block into the character shape 30.

Figure 5A:
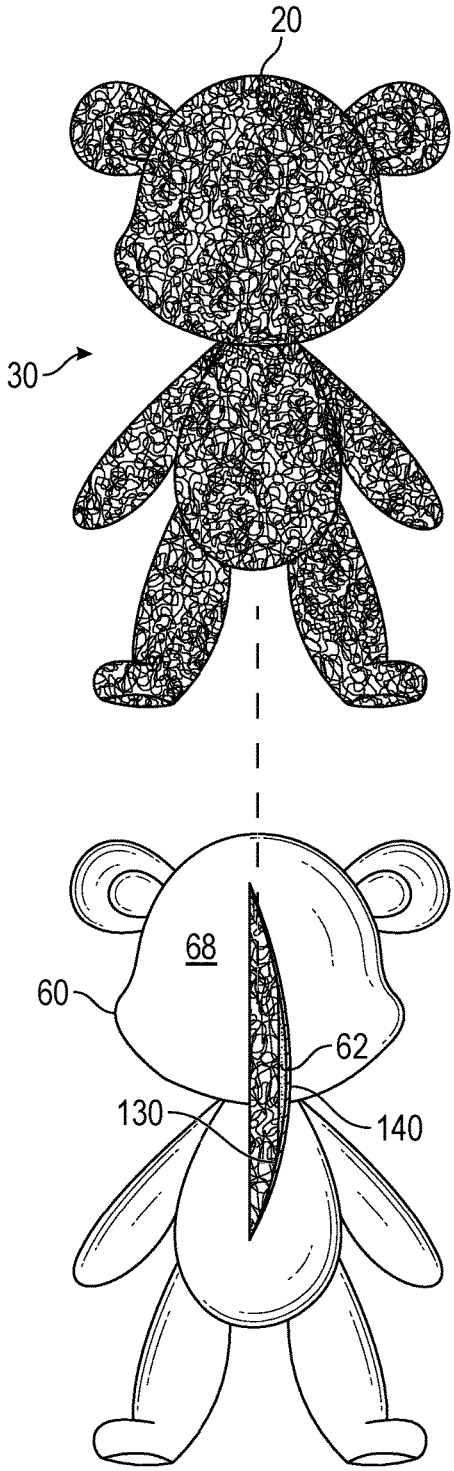
FIG. 5A is a front exploded elevational view of the foam inner, fully expanded to its natural size, and a flexible outer covering into which the foam inner is inserted.

A flexible outer covering 60 surrounds the foam inner 20 and is sized in at least one dimension to be smaller than the natural size 50 of the foam inner 20. In some embodiments the outer covering 60 may be sized substantially the same as the natural size 50 of the foam inner 20 (FIG. 5A), or larger than the natural size of the foam inner 20 when a loose, baggy look is desired for the plush toy 70. The outer cover 60 has an inner surface 62 for contacting the foam inner 20, and an outer surface 68. The foam inner 20 and the flexible outer covering 60 combine to form a plush toy 70. The covering 60 may include a flap 130 through which the foam inner 20 may be inserted during manufacturing of the plush toy 70. A closure 140, such as a zipper, hook-and-loop type fastener, mechanical snaps, or the like may be employed to close the flap 130 to seal the foam inner 20 inside the outer covering 60.

Figure 4:
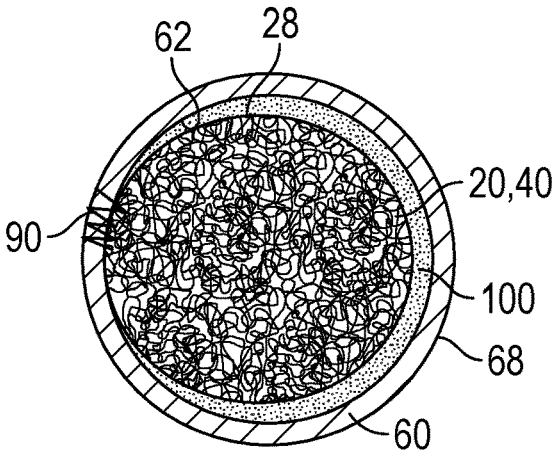
FIG. 4 is a cross-sectional view of the plush toy taken generally along line 4-4 of FIG. 1, illustrating a foam inner with an outer covering.

In preferred embodiments, at least a portion of the inner surface 62 of the outer covering 60 is fixed with the outer surface 28 of the foam inner 20 with stitching 90, adhesive 100 (FIG. 4), ultrasonic welding (not shown), or the like. Preferably the outer covering 60 is made with either a 2-way stretch material or 4-way stretch material, such as Rayon or Lycra, or other suitable web material such as woven or non-woven fabric, vinyl sheet material, or the like.

The system 10 preferably includes a package 80 having at least one open side 85 through which the plush toy 70 traversed when compressed to fill an interior space 89 of the package 80. The package 80 may be a rectanguloid 110 (FIGS. 1-3), including a cube-shaped package 80. The package 80 may also take the form of a two-piece ovaloid 120 (FIGS. 6A-6D), wherein the at least one open side 85 is exposed when separating the two pieces thereof. Such an ovaloid 120 may include a sphere-shaped package 80. At least one package closure 88, such as a paper flap, may be included for selectively sealing the at least one open side 85. In such embodiments, the end consumer of the system 10 may not know the character shape 30 of the plush toy 70 when opened, and as such an air of mystery is established with such a system 10. Alternately, the package 80 may take the form of a miniature version of the character shape 30 so as to provide an idea of the final shape of the plush toy 70 when its opened. Such a package 80 may be made of paper card stock, plastic, vinyl, glass, wood, acrylic, or the any other suitable material for a substantially rigid or resilient package 80.

In use, when the plush toy 70 is compressed and contained within the package 80, upon opening of the at least one open side 85 the plush toy 70 at least partially expands out of the at least one open side 85 of the package 80. When removed completely from the package 80 the plush toy 70 expands to the natural size 50 of the plush toy 70.

Figure 7:
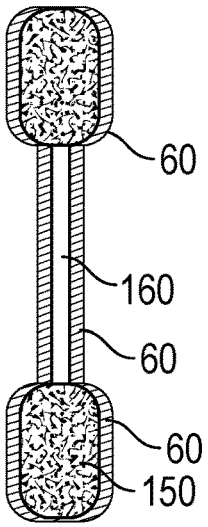
FIG. 7 is a cross-sectional view of an appendage of the plush toy having traditional fiberfill stuffing and/or no stuffing.
Figure 5B:
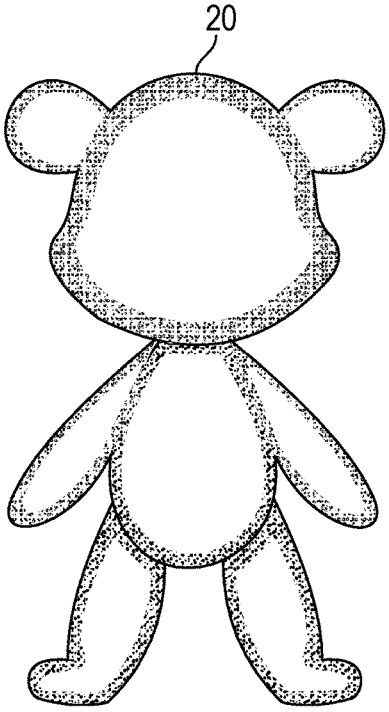
FIG. 5B is a cross-sectional view of a rear half of an alternate embodiment of the foam inner, illustrated with central hollow portions.
Figure 5C:
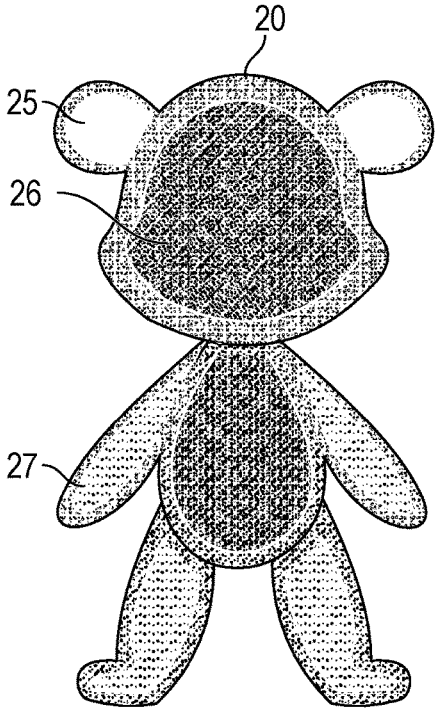
FIG. 5C is a cross-sectional view of a rear half of another alternate embodiment of the foam inner, illustrated with central hollow portions.
Figure 6A:
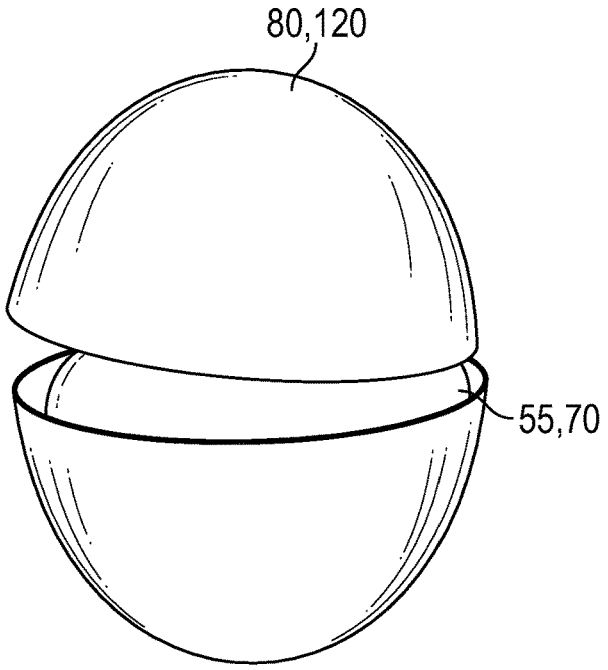
FIG. 6A is a perspective view of an alternate package of the invention, illustrated in a partially open position.
Figure 6B:
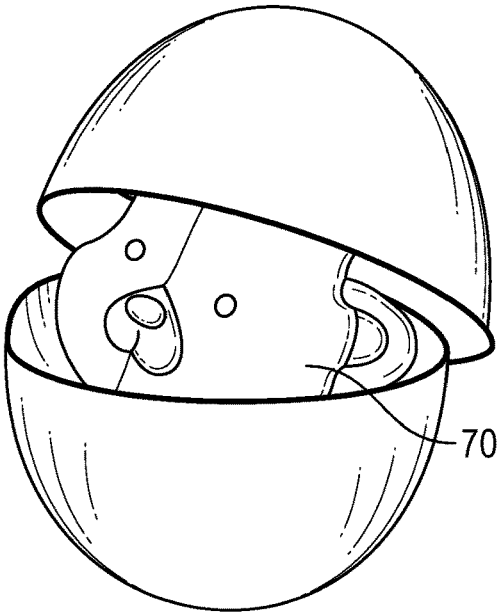
FIG. 6B is a perspective view of the embodiment of FIG. 6A, shown slightly more open and with the plush toy starting to expand towards its natural size.
Figure 6C:
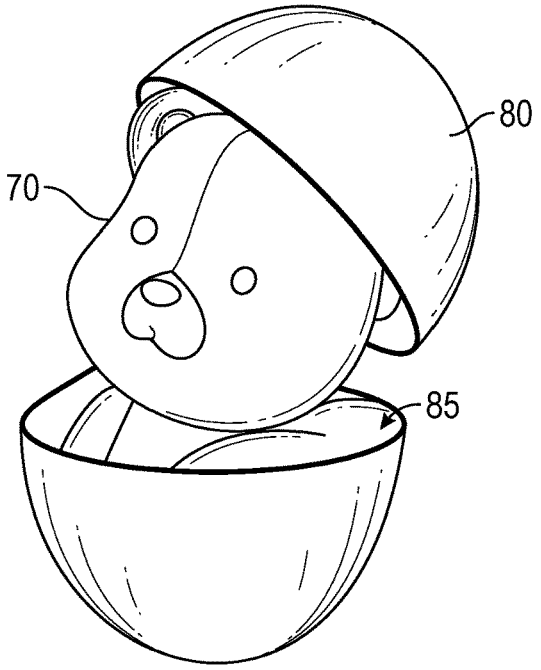
FIG. 6C is a perspective view of the embodiment of FIG. 6B, shown even more open and with the plush toy continuing to expand towards its natural size.
Figure 6D:
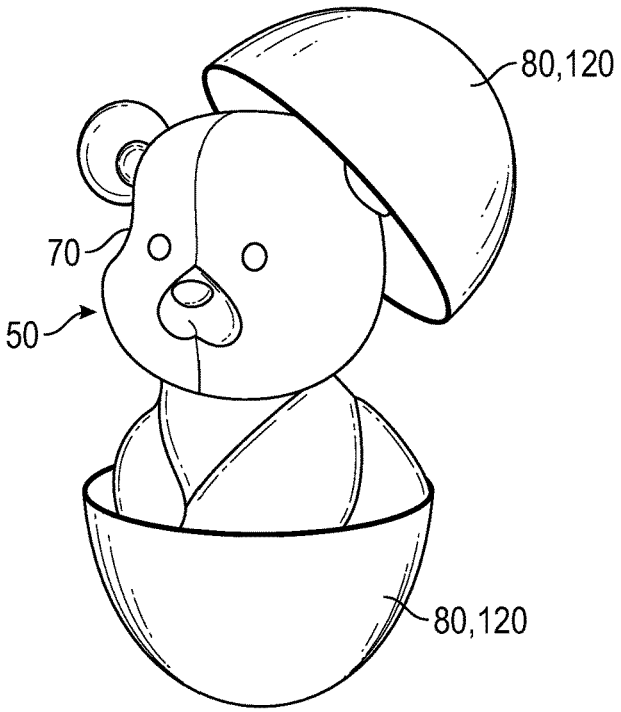
FIG. 6D is a perspective view of the embodiment of FIG. 6C, shown more fully open and with the plush toy continuing to expand towards its natural size.

In some embodiments, the foam inner 20 includes one or more appendages 22 or other sections having within a stuffing 150 (FIG. 7) taken from the group consisting of: synthetic stuffing, natural stuffing, compressible foam, wool, polyester fiberfill, feathers, beads. Such appendages 22 are not necessarily as compressible as the rest of the foam inner 20, and as such may take on different characteristics such as a different compression sound that results by compressing such an appendage 22, or a different weight or rigidity than the foam inner 20. Alternately, appendages 22 or other hollow portions 25 could be made that include no fill 160 (FIGS. 5B, 5C and 7), such as an ear of a character that remains relatively flat. Alternately appendages 22 could be made with foam material 40 having different expansion rates, or a mix of foam material 40 to get differing effects upon release of the plush toy 70 from its compressed size 55.

For example, in some embodiments, the foam inner 20 is comprised of at least two type of compressible foam material 40 that have different natural expansion rates, such that portions 26 (FIG. 5C) of the foam inner 20 with a quicker expansion rate reach their natural size 50 more quickly than other portions 27 with a foam material 40 having a slower expansion rate. As such, based on the size of the various appendages 22 and foam material 40 used therewith, the foam inner 20 may be designed such that all portions of the character shape 30 achieve their natural size 50 at roughly the same time when released from their compressed size 55. For example, the body portion 26 of the character shape 30 may include a more quickly-expanding foam material 40 than arm or leg portions 27.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A plush toy comprising:

a foam inner formed into a character shape having at least one appendage and comprising a compressible foam material having an outer surface, the foam inner having a natural size when unconstrained;

a flexible outer covering shaped to and aligned with the character shape of the foam inner and entirely surrounding the foam inner and having an unconstrained size smaller than the natural size of the foam inner, the outer covering having an inner surface for contacting the foam inner, and an outer surface;

the plush toy having a first uncompressed form with a natural size and shape, wherein the inner foam is constrained by the outer covering and does not achieve its natural size; and a second, compressed form smaller than the unconstrained form;

wherein when the plush toy is compressed to the compressed form, upon release the plush toy expands to the uncompressed form with the natural size and shape of the plush toy.

2. The system of claim 1 further including:

a package having at least one open side through which the plush toy traverses when compressed to substantially fill an interior space of the package;

whereby when the plush toy is compressed and contained within the package, upon opening of the at least one open side the plush toy at least partially expands out of the at least one open side of the package, and when removed completely from the package the plush toy expands to the natural size and shape of the plush toy.

3. The system of claim 2 wherein the package is a rectanguloid having a door flap selectively coverable over the at least one open side.

4. The system of claim 2 wherein the package is a two-piece ovaloid wherein the at least one open side is exposed when separating the two pieces.

5. The system of claim 1 wherein the foam inner is comprised of an open-cell viscoelastic foam material.

6. The system of claim 1 wherein the foam inner is comprised of a closed-cell viscoelastic foam material.

7. The system of claim 1 wherein the foam inner is comprised of a polyurethane viscoelastic foam material.

8. The system of claim 1 wherein the foam inner is comprised of a latex viscoelastic foam material.

9. The system of claim 1 wherein the foam inner is compressible to at least 33% of the natural size.

10. The system of claim 1 wherein the foam inner is made with an injection molding process.

11. The system of claim 1 wherein the foam inner is made by cutting a foam block into the shape of the character.

12. The system of claim 1 wherein the outer covering is made with a textile fabric material.

13. The system of claim 12 wherein at least a portion of the inner surface of the outer covering is fixed with the outer surface of the foam inner with stitching.

14. The system of claim 12 wherein at least a portion of the inner surface of the outer covering is fixed with the outer surface of the foam inner with an adhesive.

15. The system of claim 12 wherein at least a portion of the inner surface of the outer covering is fixed with the outer surface of the foam inner with an ultrasonic weld.

16. The system of claim 1 wherein the outer covering is made with a 2-way stretch material.

17. The system of claim 1 wherein the outer covering is made with a 4-way stretch material.

18. The system of claim 1 wherein the foam inner includes one or more appendages having within a stuffing taken from the group consisting of: synthetic stuffing, natural stuffing, compressible foam, wool, polyester fiberfill, feathers, and beads.

19. The system of claim 1 wherein the foam inner is comprised of at least two types of compressible foam material that have different natural expansion rates, such that portions of the foam inner with a quicker expansion rate reach their natural size more quickly than those areas with a foam having a slower expansion rate.

20. The system of claim 1 wherein the foam inner is substantially hollow.

* * * * *